United States Patent [19]

Burress

[11] 4,133,750

[45] Jan. 9, 1979

[54] PHOSPHATE FLOTATION PROCESS

[75] Inventor: George T. Burress, Bridgewater, N.J.

[73] Assignee: Mobil Oil Corporation, New York, N.Y.

[21] Appl. No.: 748,089

[22] Filed: Dec. 6, 1976

Related U.S. Application Data

[63] Continuation-in-part of Ser. No. 627,450, Oct. 30, 1975, abandoned.

[51] Int. Cl.[2] ..... B03C 1/02

[52] U.S. Cl. ..... 209/166

[58] Field of Search ..... 209/166, 167

[56] References Cited

U.S. PATENT DOCUMENTS

| | | | |
|---|---|---|---|
| 2,069,182 | 10/1937 | Hagued | 209/166 |
| 2,303,931 | 12/1942 | Greene | 209/166 |
| 2,373,688 | 4/1945 | Keck | 209/166 |
| 2,442,455 | 6/1948 | Booth | 209/166 |
| 3,164,549 | 1/1965 | Seymour | 209/166 |
| 3,259,242 | 7/1966 | Snow | 209/166 |
| 3,292,787 | 12/1966 | Fuerstenau | 209/106 |
| 3,405,802 | 10/1968 | Prellel | 209/166 |
| 3,859,207 | 1/1975 | Knoche | 209/166 |

*Primary Examiner*—Robert Halper

*Attorney, Agent, or Firm*—Charles A. Huggett; Raymond W. Barclay; Claude E. Setliff

[57] ABSTRACT

A process for removing phosphate ore from siliceous materials using a material comprising a combination of a sulfonated hydrocarbon and a kerosene.

5 Claims, No Drawings

PHOSPHATE FLOTATION PROCESS

CROSS REFERENCE TO RELATED APPLICATIONS

This application is a continuation-in-part of U.S. application Ser. No. 627,450 now abandoned, filed Oct. 30, 1975.

BACKGROUND OF THE INVENTION

1. Field of the Invention

The invention relates to the beneficiation of ores, especially phosphate ores. In a particular aspect the invention relates to flotation of phosphate ore from siliceous materials with agents comprising a combination of sulfonated hydrocarbon and a petroleum fraction.

2. Description of Prior Art

Phosphate ore is found in various places in nature, and it contains a valuable raw material for producing many products, principally fertilizer. The most useful constituent of the ore is calcium fluorphosphate; those of no value include calcium carbonate, carbonaceous materials, heavy minerals and siliceous materials such as silica. Removal of these valueless materials is necessary and has been the subject of extended research.

As taught in U.S. Pat. No. 3,817,972, partial concentration is first employed to remove slimes and this is followed by two separate beneficiation steps. The first one is the fatty acid flotation of phosphate values using an acid and caustic in combination with a petroleum fraction such as kerosene. The fraction obtained, or rough concentrate, still contains considerable siliceous material which is treated in a second flotation using long chain fatty acid amines or salts thereof.

U.S. Pat. No. 3,292,787 discloses that in a process for beneficiating phosphate ores by flotation, one may use a sulfonated aromatic hydrocarbon in the molecular weight range of 400 to 500. The sulfonated material is used at a concentration of at least 0.1 pound per ton in the presence of a hydrocarbon oil.

Other U.S. patents disclosing the use of sulfonated hydrocarbons in ore recovery processes are U.S. Pat. Nos. 2,069,182 and 2,442,455. None of the patents mentioned suggest or teach the fact that such extremely small amounts of sulfonated hydrocarbons and kerosene will be effective in recovery of phosphate values.

SUMMARY OF THE INVENTION

In accordance with this invention, there is provided an improved process for the beneification of phosphate ores in which there are at least two separate flotation steps, the first being a flotation step employing the usual reagents, such as a fatty acid and a petroleum fraction, and the second flotation step being one in which a long chain fatty acid amine or salt is used, such as is taught in U.S. Pat. No. 3,817,972 (incorporated herein by reference), the improvement whereby the amount of reagent in the said first flotation step is significantly reduced, while recovering substantially the same quantity of bone phosphate of lime (BPL) as with the full usual charge of reagent, by adding to the ore a reduced amount of acid and petroleum fraction, from about 0.005 to about 0.08 pound of a sulfonated hydrocarbon per ton of ore and from about 0.03 to about 0.10 pound of kerosene per ton of ore.

DESCRIPTION OF SPECIFIC EMBODIMENTS

In Florida, phosphate rock occurs in sedimentary deposits below an overburden, the top layer of which is mostly sand. The zone between the bottom of the overburden and the phosphate deposit is referred to as the "leach zone". This is a zone of aluminum phosphate minerals (mainly wavellite and cradallite) which average the equivalent of 20 to 30% aluminum phosphate, with 5 to 15% clay and the rest sand. This zone is currently discarded. The matrix is about 15 feet thick and is currently the actively-mined zone. Below the matrix is a thin layer of clay (0 to 3 feet) on top of an approximately 200-foot layer of limestone. The limestone layer contains considerable phosphate deposit and it is considered to be the source rock of the phosphate deposit. The phosphate minerals were deposited originally from warm currents of ocean water. Subsequently, the deposits were reworked by submarine currents; even later they were weathered by streams and rainfall.

The matrix is an unconsolidated mixture with a composition approximately forty percent a defect fluroapatite (the main phosphate component), thirty-nine percent quartz sand, fifteen percent a mixture of clays, and about six percent wavellite and other minerals. The clays present are montmorillonite and attapulgite. Fluorapatite has the composition $Ca_5(PO_4)_3F$. The mineral present in the ore also contains carbonate and hydroxyl as part of the structure.

In processing the ore, about 70% of the phosphate is recovered from the matrix and about 20% is lost in the slimes as particles smaller than 150 mesh (105 micrometers). Another 10% is lost with the sand tailings from the flotation plant. Of the 70% of the phosphate recovered, about 16% is pebble (the larger pieces) and 54% is concentrate from the flotation.

Without detailing the flotation operation, the general problems of separation are associated with the wide particle distribution of sand and phosphate in the flotation feed. This distribution occurs even though the feed is segregated into two sizes. While the fatty acid float is selective, there is a tendency for the larger phosphate particles to settle too quickly and thus are lost as tailings. The fine sand settles too slowly and is floated with the phosphate rock. In the second flotation to remove this floated sand, the amine/kerosene flotation is simply less selective, and thus a good portion of the phosphate is lost with the floating sand.

Normally, in the first or fatty acid flotation step, from about 0.9 to about 1.0 pound of acid per ton of ore is used, along with about 3 times as much petroleum fraction, i.e., from about 2.7 pounds to about 3.0 pounds per ton thereof. With optimum use of these reagents, one can obtain a recovery of up to about 95-97% of the BPL in the flotation feed. This represents about the maximum one can attain with this reagent system in this step. When the amount of reagents used in the fatty acid flotation step are added to those used in the amine, or second, flotation, the total quantity of reagent is quite substantial and accounts for a considerable proportion of the total cost of processing phosphate ore.

Mindful of the losses discussed above, the industry has searched for ways to reduce not only the loss of valuable products, but has also searched for ways to reduce reagent consumption without significant reduction in the overall recovery of BPL values from phosphate ore. It has been found that the combination of this invention can be used in combination with the conventional fatty acid flotation reagents to reduce the amount of the latter.

The sulfonated hydrocarbons of this invention are by-products of the sulfonation of lube oil fractions to make mineral oil (white oil). They contain aromatic portions and these comprise benzene and naphthalene with long side chains, such that the molecular weight of the total sulfonated hydrocarbon is in the range of from about 350 to about 500, preferably from about 400 to about 450.

They can be used effectively at levels of from about 0.005 to about 0.08 pound thereof per ton of ore. When used in this amount for the purposes of this invention, they are placed in combination with from about 0.03 to about 0.10 pound of kerosene per ton of ore. As has been intimated, the combination is used in the acid flotation step along with the usual fatty acid and petroleum fraction, which is preferably a No. 6 fuel oil. As has already been mentioned, fatty acids and the petroleum fractions are normally used in concentrations of about 1 pound per ton of ore and about 3 pounds per ton or ore, respectively. The reagents of this invention allow the use of considerably less of both conventional materials. Specifically, when used in combination with sulfonated aromatic hydrocarbon and petroleum fraction, fatty acid is effective at concentrations of from about 0.3 to about 0.7 pounds per ton of ore. The petroleum fraction concentration will normally be about three times that of the aromatic hydrocarbon or fatty acids, i.e., from about 0.9 to about 2.1 pounds per ton of ore thereof. The petroleum fraction can be any of a number of products, including the distillate fuel oils. With respect to the fuel oils, Nos. 1 through 6 may be used to advantage. Further, the term "petroleum fraction" includes all other oils commonly used in the flotation of phosphate ores. Properties are described on pages 11–41 through 11–54 of Petroleum Processing Handbook, McGraw-Hill Book Company (1967).

Having described the invention in general terms, the following Examples will serve as illustrations. They are illustrative only and are not intended to limit the invention.

EXAMPLE 1

Fatty acid in the amount of 0.66 pound per ton of ore and 1.98 pounds per ton of ore of a No. 6 fuel oil were used as a beneficiating agent in the flotation of a Florida phosphate rock. The acid used had the following composition:

| Acid | Percent |
|---|---|
| Palmitic | 6 |
| Palmitoleic | 2 |
| Stearic | 1 |
| Oleic | 31 |
| Linoleic | 42 |
| Docosenoic | 3 |
| Linolenic | 5 |
| Rosin | 7 |
| Unsaponifiables | 3 |

There was produced a float concentrate of 92.6% BPL recovery. A repeat of the run was made, except that in addition to the same quantities of acid and fuel oil, 0.03 pound per ton of ore of sulfonated aromatic hydrocarbon and 0.04 pound per ton of ore of kerosene were added. With this extremely small amount of sulfonated hydrocarbon and kerosene the BPL recovery was increased to 97.0%. The sulfonated hydrocarbon was as described in the matter just preceding this Example and had an average molecular weight of 420.

EXAMPLE 2

0.60 pound per ton of ore of the fatty acid of Example 1 and 1.80 pounds per ton of ore of No. 6 fuel oil were used in the flotation of Florida phosphate rock. The float concentrate contained 93.5% BPL. The run was repeated, except that 0.05 pound per ton of ore of the sulfonated hydrocarbon of Example 1 and 0.10 pound per ton of ore of kerosene was used in addition to the same quantity of acid and fuel oil. This float contained 95.7% BPL.

EXAMPLE 3

In this run, use of 0.54 pound per ton of ore of the acid of Example 1 and 1.62 pounds per ton of ore of NO. 6 fuel oil gave a float containing 77.8% BPL. A repeat of the run, using 0.04 and 0.10 pound per ton of ore respectively of the sulfonated hydrocarbon and kerosene of Example 1, the % BPL in the float was increased to 93.7. As in Examples 1 and 2, the same amount of acid and fuel oil were used.

EXAMPLE 4

Using 0.69 and 2.07 pounds per ton of ore respectively of the acid and fuel oil of Example 1, a float was obtained containing 95% BPL. With the same amount of acid and fuel oil, but with 0.10 and 0.10 pound per ton of ore respectively of the sulfonated hydrocarbon and kerosene of Example 1, a float was obtained containing 96% BPL.

The synergistic effect of the combination of low amounts of aromatic hydrocarbon plus kerosene may be easily seen from the above Examples. In Example 4, using 0.69 and 2.07 pounds, respectively of acid and fuel oil, about the maximum recoverable with this system is attained (95% BPL). This is increased little (only 1% BPL) upon the addition of 0.1 pound each of sulfonated hydrocarbon and kerosene.

The entirely unexpected effect is demonstrated clearly in Example 3. When an ore is floated using 0.54 and 1.62 pounds per ton, respectively, of acid and fuel oil, the recovery was only 77.8% BPL. Upon the addition of 0.04 and 0.10 pounds per ton, respectively, of sulfonated hydrocarbon and kerosene, the BPL recovery increased to 93.7%.

Other increases are shown in Examples 1 and 2. In Example 1, even the addition of only 0.03 and 0.04 pound, respectively, of sulfonated hydrocarbon and kerosene gave an increase BPL yield of 4.4%.

I claim:

1. An improved process for the beneficiation of phosphate ores in which there are at least a fatty acid flotation and an amine flotation, the improvement whereby the amount of reagent in the fatty acid flotation step is significantly reduced while recovering substantially the same quantity of bone phosphate of lime, said improvement being achieved by adding to the ore prior to said fatty acid flotation step from about 0.3 to about 0.7 pound per ton of ore of a fatty acid and from about 0.9 to about 2.1 pounds per ton of ore of a petroleum fraction and a combination comprising from about 0.005 to about 0.08 pound per ton of ore of a sulfonated aromatic hydrocarbon having a molecular weight of from about 350 to about 500 and from about 0.03 to about 0.10 pound per ton of ore of kerosene.

2. The process of claim 1 wherein the molecular weight is from about 400 to about 450.

3. The process of claim 1 wherein the acid used is as defined in Example 1 of the specification.

4. The process of claim 1 wherein the sulfonated hydrocarbon is as defined in Example 1 of the specification.

5. The process of claim 1 wherein the petroleum fraction is present to the extent of about three times the amount of said acid.

* * * * *